US006217679B1

(12) United States Patent
Kohno et al.

(10) Patent No.: US 6,217,679 B1
(45) Date of Patent: Apr. 17, 2001

(54) METHOD FOR PRODUCING CHROMIUM-CONTAINING HOT ROLLED STEEL STRIP

(75) Inventors: Masaaki Kohno; Kunio Fukuda; Kazuhide Ishii; Susumu Satoh; Hiroshi Yaginuma; Takumi Ujiro, all of Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/194,129

(22) PCT Filed: Mar. 25, 1998

(86) PCT No.: PCT/JP98/01320

§ 371 Date: Nov. 23, 1998

§ 102(e) Date: Nov. 23, 1998

(87) PCT Pub. No.: WO98/44168

PCT Pub. Date: Oct. 8, 1998

(30) Foreign Application Priority Data

Mar. 27, 1997 (JP) ..... 9-075092

(51) Int. Cl.[7] ..... C21D 8/02

(52) U.S. Cl. ..... 148/636; 148/602; 148/606; 148/609

(58) Field of Search ..... 148/597, 601, 148/602, 605, 606, 609, 625, 636

(56) References Cited

U.S. PATENT DOCUMENTS 5,131,126 * 7/1992 Katsuki et al. ..... 29/81.06
5,202,002 * 4/1993 Tsuchinaga et al. ..... 204/145 R

FOREIGN PATENT DOCUMENTS 61-249603 * 11/1986 (JP) .
62-253732 * 11/1987 (JP) .
5-320771 * 12/1993 (JP) .
6-15308 * 1/1994 (JP) .
7-216568 * 8/1995 (JP) .
8-10823 * 1/1996 (JP) .

* cited by examiner

*Primary Examiner*—Deborah Yee
(74) *Attorney, Agent, or Firm*—Young & Thompson

(57) ABSTRACT

The invention provides hot-rolled steel strips which, after having been acid-pickled, can be directly used. The strips have no Cr-decreasing layer and no shot blasted marks on their surface and have good corrosion resistance. The invention also provides a technique of efficiently producing the hot-rolled steel strips. A steel slab having a Cr content of from 6.0 to 25.0 wt. % is hot-rolled, then coiled at a temperature not higher than 700° C., then optionally quenched in water immediately after the coiling, then annealing in a reducing atmosphere, and thereafter acid-pickled in a solution of nitric acid/hydrochloric acid.

12 Claims, No Drawings

METHOD FOR PRODUCING CHROMIUM-CONTAINING HOT ROLLED STEEL STRIP

TECHNICAL FIELD

The present invention relates to hot-rolled steel strips (including sheet steel—the same shall apply herein under) of Cr-containing steel such as typically stainless steel, and to a method for producing them. In particular, it relates to hot-rolled, Cr-containing steel strips as obtained by efficiently removing the surface scale of the strips within a short period of time but without detracting from the surface quality and the corrosion resistance thereof, and to a method for producing them.

BACKGROUND ART

As having good corrosion resistance, stainless steel containing Cr and/or Ni now has many increasing applications. However, since stainless steel is a high alloy containing a large amount of expensive elements such as Cr and Ni and since it is produced in a complicated process comprising slabbing→hot-rolling→(annealing of hot-rolled strips)→acid-pickling of hot-rolled strips→cold-rolling→annealing of cold-rolled strips→acid-pickling of cold-rolled strips, stainless steel is problematic in that its production costs are high. Given that situation, recently, proposed was a technique of omitting a part of those steps of the production process. In particular, hot-rolled steel strips not subjected to the cold-rolling step and the subsequent steps have been widely noticed to reduce the production costs and to shorten the production time.

In general, however, the surface scale of hot-rolled strips of Cr-containing steel such as typically stainless steel is, being different from that of cold-rolled and annealed strips thereof which will be referred to herein under, thick and often has a thickness of a several $\mu$m, and, in addition, it is dense and is therefore difficult to remove when compared with the surface scale of carbon steel. For these reasons, therefore, the surface scale of hot-rolled, Cr-containing steel strips is generally removed through pre-treatment of dipping the strips in a sulfuric acid-containing tank followed by acid-pickling finish-treatment of further dipping them in a mixed acid of nitric acid and hydrofluoric acid, for example, according to the technique disclosed in Stainless Steel Handbook (3rd Ed., published by Nikkan Kogyo Newspaper Co. in 1995), page 840. Since the descaling to be effected by acid-cleaning of only such acid-dipping takes a long period of time, mechanical destruction and removal of scale, such as shot-blasting, is often effected prior to acid-dipping for the purpose of shortening the descaling time.

To anneal cold-rolled stainless steel strips, generally employed is a method of treating the strips in a strong reducing atmosphere (blight annealing) or a method of treating them in a combustible atmosphere. The surface film to be formed as a result of the former annealing treatment is extremely thin, and the strips thus treated may have a good surface gloss as they are. However, scale is formed on the strips as annealed by the latter treatment, and it has a negative influence on the corrosion resistance and will gall the die of a mold through which the sheets are press-molded. Therefore, the strips annealed in the latter method must be subjected to acid-pickling. Prior to acid-pickling, the strips are pre-treated by salting them in an alkali salt melt consisting essentially of NaOH and $Na_2NO_3$ or by electrolyzing them in a neutral salt solution of $Na_2SO_4$, $NaNO_3$ or the like, and thereafter dipped in an aqueous solution of sulfuric acid, nitric acid/hydrofluoric acid, nitric acid or the like.

Optionally, the strip are then further hydrolyzed. Concrete methods of such acid-cleaning are disclosed in, for example, Japanese Patent Publication (JP-B) Sho-38-12162 and Japanese Patent Application Laid-Open (JP-A) Sho-59-59900.

Recently, for some cold-rolled, ferrite-type stainless steel strips, employed is a method of passing the strips at a high speed through a mixed gas atmosphere comprising inert gas such as $N_2$ gas and a several % by volume of reducing $H_2$ gas, for example, in a continuous annealing line (CAL) for low carbon steels. Low carbon steel is not oxidized in that reducing atmosphere. As opposed to this, however, when stainless steel containing Cr that is easily oxidized is treated in that atmosphere, a thin oxide film consisting essentially of Fe and Cr and having a thickness of hundreds Å (angstroms) or so is formed on its surface, as so written in Netsu-syori, Vol. 28, No. 6 (1988), pp. 373–378. Therefore, Cr-containing stainless steel treated in that atmosphere requires descaling. Descaling methods are disclosed in, for example, Japan Patent Application Laid-Open (JP-A) Sho-63-216999 and (JP-A) Hei-1-147100.

However, the conventional acid-pickling method of dipping hot-rolled stainless steel strips in sulfuric acid and in nitric acid/hydrofluoric acid is problematic in that, even when it is combined with mechanical descaling, its descaling ability is poor and its producibility is low, and that, although the scale layer could be removed in the method, a Cr-decreasing layer having been formed below the scale layer could not be dissolved satisfactorily therein, resulting in that the corrosion resistance of the steel strips treated in the method is lower than that of steel strips having the same composition and having been mechanically treated to remove the Cr-decreasing layer therefrom through surface polishing. In a hot-rolled stainless steel strip, the Cr-decreasing layer is formed around its surface just below the scale layer formed thereon. Where the hot-rolled band is then cold-rolled, the Cr-decreasing layer will be drawn to be extremely thin, and will no more have any negative influence on the corrosion resistance of thestrip. However, where the hot-rolled strip is, without being cold-rolled, to be a final product which is directly put into practical use, the Cr-decreasing layer still existing as such causes the reduction in the corrosion resistance of the strip.

On the other hand, mechanical descaling such as shot-blasting is problematic in that it gives work defects of so-called "shot blasted marks" to the surface of steel strips, and the shot blasted marks still remain on the surface even after acid-cleaning to worsen the surface properties of the strips. Further, the shot blasted marks worsen the surface gloss of cold-rolled strips, and in addition, have a negative influence on the surface polishing of hot-rolled strips to thereby increase the production costs and lower the producibility.

Given that situation, the object of the present invention is to solve the problems that have heretofore been inevitable in the prior art of producing Cr-containing steel strips such as typically stainless steel strips, and to provide hot-rolled steel strips which have no Cr-decreasing layer on their surface, which have good corrosion resistance even when they are directly used after having been acid-pickled, which have no shot blasted mark, and which have good surface properties and good surface polishability. The invention also provides an. effective method for producing the hot-rolled steel strips.

DISCLOSURE OF THE INVENTION

In order to realize the object, we, the present inventors have assiduously studied the Cr content of steel compositions, the hot-rolling condition for Cr-containing steel strips, the annealing condition for the hot-rolled strips and the acid-pickling condition for the annealed strips, and, as a result, have found an efficient method of producing hot-rolled, Cr-containing steel strips which, after having been acid-pickled, have good corrosion resistance and have no shot blasted mark. Specifically, the inventors have found that, when hot-rolled, Cr-containing steel strips are annealed in a reducing atmosphere to thereby reduce the scale having been formed during the hot-rolling, and thereafter acid-pickled in a solution of nitric acid/hydrochloric acid, then the thus-treated steel strips well have the intended good characteristics, that the method of treating the strips is much more efficient than any other conventional methods, and that, when the coiling condition in the hot-rolling step, and also the annealing atmosphere and the acid-pickling condition for the hot-rolled strips are suitably controlled, then the acid-pickling time can be shortened. On the basis of these findings, the inventors have completed the present invention.

Specifically, the constitution of the present invention is summarized as follows:

(1) A hot-rolled, Cr-containing steel strip having a Cr content of from 6.0 to 25.0 % by weight and having good surface properties and good corrosion resistance, which is characterized in that its surface has no shot blasted mark and has substantially no Cr-decreasing layer. Preferably, the strip has a Cr content of from 9.0 to 25.0 % by weight.

(2) A method for producing a hot-rolled, Cr-containing steel strip, comprising hot-rolling a steel slab having a Cr content of from 6.0 to 25.0% by weight, then annealing it in a reducing atmosphere, and thereafter acid-pickling it in a solution of nitric acid/hydrochloric acid. In the method, preferably, the steel slab has a Cr content of from 9.0 to 25.0% by weight.

(3) A method for producing a hot-rolled, Cr-containing steel strip, comprising hot-rolling a steel slab having a Cr content of from 6.0 to 25.0% by weight, then annealing it in a reducing atmosphere, then brushing it with a brushing roll having a grinding ability, and thereafter acid-pickling it in a solution of nitric acid/hydrochloric acid.

(4) The method of any one of (2) or (3) for producing a hot-rolled, Cr-containing steel strip, wherein the solution of nitric acid/hydrochloric acid for the acid-cleaning has a nitric acid concentration of from 10 to 300 g/liter and a hydrochloric acid concentration of from 1 to 50 g/liter, and its temperature falls between 35 and 65° C.

(5) The method of any one of (2) to (4) for producing a hot-rolled, Cr-containing steel strip, wherein the acid-pickling is effected by electrolytically dipping the strip in a solution of nitric acid/hydrochloric acid at a current density of from 1 to 30 $A/dm^2$.

(6) The method of any one of (2) to (5) for producing a hot-rolled, Cr-containing steel strip, which comprises hot-rolling a steel slab having a Cr content of from 6.0 to 25.0% by weight, then coiling it at a temperature not higher than 700° C. and optionally quenching it in water immediately after the coiling, then annealing it in a reducing atmosphere, and thereafter acid-pickling it in a solution of nitric acid/hydrochloric acid.

(7) The method of any one of (2) to (6) for producing a hot-rolled, Cr-containing steel strip, wherein the annealing atmosphere is comprised of hydrogen gas and nonoxidizing gas while having a hydrogen concentration of not smaller than 1% by volume, and has a dew point falling between −600° C. and 0° C.

(8) In the method of any one of (2) to (7) for producing a hot-rolled, Cr-containing steel strip, the coiling condition in the hot-rolling step, the annealing atmosphere, the brushing condition after the annealing step and the acid-pickling condition are further defined to be preferred ones.

Now, the invention is described in detail herein under.

[Cr Content: 6.0 to 25.0% by weight]:

Cr is an element indispensable for the corrosion resistance of the steel strip, and its content is determined depending on the corrosion resistance level in practical use of the steel strip. If the Cr content is lower than 6.0% by weight, Cr is ineffective for improving the corrosion resistance of the steel strip. Therefore, the lowermost limit of the Cr content shall be 6.0% by weight. On the other hand, if the Cr content is higher than 25% by weight, scale still remains on the acid-cleaned steel strip to lower the corrosion resistance of the steel band. The reason is because, if the steel strip contains Cr in an amount larger than 25.0% by weight, the Cr content in the scale formed around the hot-rolled strip will increase to thereby lower the acid-pickling ability of the steel strip, and in addition, in the annealing step, Cr will be oxidized while the scale around the strip is reduced. Therefore, the Cr content is defined to fall between 6.0 and 25.0% by weight, preferably between 9.0 and 25.0% by weight.

The other steel components except Cr may be determined, depending on the intended characteristics of the steel strip, for example, as those defined in JIS (Japan Industrial Standards) G4304, G4305, G4306, G4307.

[Coiling at a temperature not higher than 700° C. after hot-rolling, or cooling in water of hot-rolled and coiled strip]:

After having been hot-rolled, the steel strip is coiled at a temperature not higher than 700° C., and optionally cooled in water, whereby Fe-based scale having been formed during the step of coiling the hot-rolled strip with gradually cooling it is reduced and Cr is oxidized to inhibit the formation of Cr-based scale.

If the coiling, temperature is higher than 700° C., the acid-pickling ability of the strip is lowered. The reason is because the scale layer having been formed in the coiling and cooling step will have a Cr-rich area therein, resulting in that the scale reduction by annealing and even the acid-pickling will become difficult. Where the coiling temperature is not higher than 600° C., the acid-pickling of the strip is easier. Therefore, the coiling temperature is preferably not higher than 600° C.

[Annealing atmosphere: hydrogen content of not lower than 1% by volume, dew point falling between −60 and 0° C.]:

In the invention, the annealing treatment is to remove the strain from the hot-rolled steel strip and to induce recrystallization of the steel strip, and, in addition, it is to deoxidize the scale having been formed around the hot-rolled steel strip while inhibiting the formation of Cr-based scale.

Regarding the condition of the annealing atmosphere, if the hydrogen content of the atmosphere is lower than 1% by volume or if the dew point of the atmosphere is higher than 0° C., the ability of the atmosphere to deoxidize scale having been formed around the hot-rolled strip is lowered. On the other hand, if the dew point of the atmosphere is lower than −60° C., Cr is selectively oxidized during the annealing step, whereby the acid-pickling ability of the annealed strip is lowered. If the hydrogen content of the annealing atmosphere is higher than 20% by volume, Cr is also selectively oxidized during the annealing step to lower the acid-pickling ability of the annealed strip. For these reasons, the preferred condition of the annealing atmosphere is such that its hydrogen content is from 1 to 20% by volume and its dew point falls between −60 and 0° C.

The annealing temperature may be determined, depending on the recrystallization point of the steel strip to be annealed. For example, preferably, it falls between 800 and 1000° C. for annealing ferritic stainless steel, and falls between 1000 and 1200° C. for annealing austenitic stainless steel.

These conditions are based on the inventors' findings. Specifically, while studying the influence of the annealing atmosphere on the formation of scale around the annealed steel strips, the inventors have found that the scaling behavior during annealing differs between hot-rolled steel strips (having scale on their surface) and cold-rolled steel strips (having no scale on their surface).

Precisely, where cold-rolled, Cr-containing steel strips are annealed in the atmosphere defined herein, Cr-based oxide scale is formed around the strips. As opposed to those, however, where hot-rolled, Cr-containing steel strips are annealed in the same atmosphere defined herein according to the present invention, the scale having been formed around the strips during hot-rolling is deoxidized during annealing to form a deoxidized iron layer on the surface of the strips. This deoxidized iron layer prevents Cr in the alloy from being contacted with the annealing atmosphere and prevents the oxidation of Cr to be induced by the contact. As a result, in the invention, Cr is not oxidized to give any additional Cr-decreasing layer during the annealing step, and, in addition, the Cr-decreasing layer just below the scale having been formed in the hot-rolling step could be deoxidized through the diffusion of Cr in the alloyed composition of the steel band and through the homogenization of the alloyed composition thereof during the annealing step.

Anyhow, the annealing to be effected in the defined atmosphere is satisfactory for indispensably deoxidizing the scale having been formed around the hot-rolled strips while inhibiting the oxidation of Cr in the annealed strips.

[Brushing after annealing]:

The brushing treatment after annealing, which is effected with a brushing roll having a grinding ability, is to cut off and remove a part of the deoxidized layer and a part of the remaining scale layer from the surface of the steel strip, and it is effective for further enhancing the acid-pickling ability of the steel strip while retarding the deterioration of the acid-pickling solution. The brushing roll to be used for the brushing treatment is composed of grinding grains of, for example, alumina, silicon carbide, tungsten carbide or the like, and a substrate to be the binder for those grinding grains, which is elastic and deferrable according to pressure applied thereto, for example a polymer roll of nylon or the like or a non-woven roll. It is desirable that the brushing roll can follow the surface profile of the steel strip being brushed therewith to exhibit a good grinding function.

[Solution of nitric acid/hydrochloric acid, having a nitric acid concentration of from 10 to 300 g/liter and a hydrochloric acid concentration of from 1 to 50 g/liter, and having a temperature falling between 35 and 65° C.]:

If the nitric acid concentration in the solution is lower than 10 g/liter, it is difficult to passivate the steel strip within a short period of time. On the other hand, if the concentration is higher than 300 g/liter, the amount of NOx to be generated by the treatment increases. If the hydrochloric acid concentration in the solution is lower than 1 g/liter, it is difficult to descale the steel strip at a high speed. On the other hand, if the concentration is higher than 50 g/liter, the surface of the steel strip treated is roughened and the corrosion resistance of the steel strip is lowered.

For these reasons, the composition of the mixed acid solution of nitric acid/hydrochloric acid to be used herein is defined to have a nitric acid concentration of from 10 to 300 g/liter and a hydrochloric acid concentration of from 1 to 50 g/liter, but preferably a nitric acid concentration of from 50 to 200 g/liter and a hydrochloric acid concentration of from 3 to 30 g/liter.

If the temperature of the solution is lower than 35° C., the acid-pickling treatment could not be attained within a short period of time. However, if the temperature is higher than 65° C., the amount of NOx to be generated by the treatment increases and the surface of the steel strip treated is roughened. Accordingly, the temperature of the acid-pickling solution is defined to fall between 35 and 65° C., but preferably between 40 and 60° C.

[Current density for electrolytic dipping treatment: 1 to 30 A/dm$^2$]:

By electrolyzing the steel strip in the solution of nitric acid/hydrochloric acid, the Cr-based scale having remained a little on the surface of the steel strip can be dissolved and removed. Therefore, the acid-pickling may be optionally combined with electrolysis. However, if the current density during the electrolysis is higher than 30 A/dm$^2$, the amount of NOx to be generated by the treatment increases and the surface of the steel strip treated is roughened. Therefore, the current density is defined to be from 1 to 30 A/dm$^2$, but preferably from 5 to 25 A/dm$^2$.

BEST MODES OF CARRYING OUT THE INVENTION

Now, the invention is described concretely with reference to the following Examples.

EXAMPLE 1

Five steel slabs of Type 409 (11 wt % Cr-0.2 wt % Ti) from the same heat were reheated at 1100° C., then hot-rolled into strips having a thickness of 1.5 mm, and thereafter coiled at a different temperature of 780, 700, 600 or 540° C. One slab was, after having been coiled at 780° C., immediately put into a water tank to cool it.

Hot-rolled steel sheet samples were sampled from those coils, and then annealed and acid-pickled under the conditions indicated in Table 1. The annealing pattern was comprised of heating up to 900° C. during about 200 seconds, soaking at 900° C. for 60 seconds, and cooling in air in that order. Some samples were, after having been annealed, brushed with a grinding brush (Model 16S-100-3H, manufactured by Hotani Co.).

For comparison, samples of the hot-rolled sheet were treated in a conventional manner. Precisely, the comparative samples were annealed (in a combustible atmosphere), and then acid-pickled. Some samples were shot-blasted for mechanical descaling prior to the acid-pickling. The acid-pickling pattern was comprised of dipping in sulfuric acid (200 g/liter) for 40 seconds and dipping in a mixed acid solution of nitric acid (100 g/liter) and hydrofluoric acid (20 g/liter) for 40 seconds in that order.

The descaling of the samples was evaluated visually. The samples that had been descaled satisfactorily were marked with "O"; those still having a little scale were marked with "Δ"; and those having much scale were marked with "X".

The corrosion resistance of the samples was evaluated as follows: Each sample was cut into test pieces having a size of 6 cm×8 cm (test area: 96 cm$^2$), and the test pieces were subjected to a salt spray test (SST (JIS Z2371) in which a solution of 5% NaCl was sprayed over them for 10 hours. After the test, the number of rust-starting points seen in each test piece was counted, on the basis of which the samples were evaluated as follows:

O: 0 point/test piece

Δ: 1 to 2 points/test piece

X: 3 or more points/test piece

When the surface of the steel sheet samples from the same heat as in the above was ground and polished to completely remove the Cr-decreasing layer therefrom, it was confirmed that the thus-polished steel sheets did not rust at all after the SST test.

To evaluate the samples as to whether or not they have a Cr-decreasing layer on their surface, the samples were tested as follows: The Cr concentration in the surface of each acid-pickled sample was determined, using EPMA (electron probe microanalyzer). The device, EPMA gives a relative error of +/−4%, when used for measuring the Cr content of steel. The data measured were compared with the Cr content of the bulk of steel. It was judged that the samples of which the Cr content measured in their surface was lower by at least 4% than the Cr content of the steel bulk "had a Cr-decreasing layer on their surface".

The shot-blasted samples were, after having been acid-pickled, observed through SEM to check the presence or absence of shot blasted marks on their surface.

The test data shown in Table 1 verify the following: The comparative samples having been subjected to the steps of shot-blasting, acid-pickling with sulfuric acid and acid-pickling with nitric acid/hydrofluoric acid in that order in accordance with a conventional process in which the acid-pickling time was 80 seconds (Test Nos. 1, 2) rusted after the SST test. The comparative sample having been subjected to the same conventional process in which the acid-pickling time was 40 seconds (Test No. 3) and the comparative sample having been subjected to the same conventional process in which, however, the shot-blasting was omitted (Test No. 4) both had scale and a Cr-decreasing layer on their surface, and the corrosion resistance of those samples was very poor.

As opposed to those, the samples of the invention (Test Nos. 5 to 21) were all completely descaled after the acid-pickling effected for 40 seconds. In addition, it is known that the corrosion resistance of the acid-pickled samples of the invention was good. Naturally, no shot blasted mark remained on the surface of those samples, and the surface properties of those samples were good. It is additionally known that the samples having been coiled at a temperature not higher than 700° C. had no scale on their surface even when the acid-pickling time for them was shortened, and that hot-rolled steel sheets treated in that condition had good corrosion resistance.

As in the above, hot-rolled steel strips of good and stable quality were produced within a short period of time by optimizing the annealing atmosphere, the acid-pickling solution and the condition for electrolysis. Where the samples were brushed prior to being subjected to acid-pickling, their acid-pickling ability was much improved.

EXAMPLE 2

Ferrite-type stainless steel samples of Type 430 (16 Cr steel), 25 Cr steel and 30 Cr steel were treated in the same manner as in Example 1. In this, however, the samples of 16 Cr steel (Test Nos. 22 to 27) were annealed by heating them up to 850° C. during about 200 seconds, then soaking them at 850° C. for. 60 seconds, and thereafter air cooling them; while the other samples were annealed by heating them up to 950° C. during about 200 seconds, then soaking them at 950° C. for 60 seconds, and thereafter air cooling them. To determine the corrosion resistance of the samples, the samples were subjected to SST (SST=salt spray test) for 20 hours. The presence or absence of the Cr-decreasing layer on the treated samples was checked in the same manner as in Example 1. The data obtained-herein are shown in Table 2. The samples of 16 wt % Cr to 25 wt % Cr steel of the present invention (Test Nos. 23 to 27, 30) had no scale on their surface and had good corrosion resistance, like the samples of the invention in Example 1. However, the samples of 30Cr steel (Test Nos. 31, 32) still had scale on their surface, even after having been treated according to the method of the invention.

TABLE 1

| | | | Annealing | | | | | Acid-pickling Condition | | | | | | | | |
|---|---|---|---|---|---|---|---|---|---|---|---|---|---|---|---|---|
| | | | Coiling | Atmosphere | | | | | | | | | | | | |
| Test No. | Steel Type | | Temperature (° C.) | $H_2$ vol % | $N_2$ vol % | Dew Point ° C. | Grinding Brush | Nitric Acid g/l | Hydrochloric Acid g/l | Temperature ° C. | Current Density A/dm$^2$ | Pickling Time sec | Descaling | Corrosion Resistance | Cr-decreasing Layer | Shot Blasted Marks |
| 1 | 11Cr | Comparative Example | 780 | 5%$O_2$ + 95%$N_2$ | | | Not used | Shot-blasting + sulfuric acid + nitric acid/hydrofluoric acid | | | | 80 | ○ | Δ | Not Exist | Exist |
| 2 | 11Cr | Comparative Example | 540 | 5%$O_2$ + 95%$N_2$ | | | Not used | Shot-blasting + sulfuric acid + nitric acid/hydrofluoric acid | | | | 80 | ○ | Δ | Not Exist | Exist |
| 3 | 11Cr | Comparative Example | 540 | 5%$O_2$ + 95%$N_2$ | | | Not used | Shotblasting + sulfuric acid + nitric acid/hydrofluoric acid | | | | 40 | X | X | Exist | Exist |
| 4 | 11Cr | Comparative Example | 540 | 5%$O_2$ + 95%$N_2$ | | | Not used | Sulfuric acid + nitric acid/hydrofluoric acid | | | | 80 | X | X | Exist | Not Exist |
| 5 | 11Cr | Sample of the Invention | 780 | 5 | 95 | −30 | Not used | 100 | 10 | 45 | 10 | 40 | ○ | ○ | Not Exist | Not Exist |
| 6 | 11Cr | Sample of the Invention | 780 | 5 | 95 | −30 | Not used | 100 | 10 | 45 | 10 | 30 | ○ | Δ | Not Exist | Not Exist |
| 7 | 11Cr | Sample of the Invention | 780 | 5 | 95 | −30 | Not used | 100 | 10 | 45 | 10 | 20 | ○ | Δ | Not Exist | Not Exist |

TABLE 1-continued

| Test No. | Steel Type | | Coiling Temperature (° C.) | Annealing Atmosphere $H_2$ vol % | $N_2$ vol % | Dew Point ° C. | Grinding Brush | Acid-pickling Condition Nitric Acid g/l | Hydrochloric Acid g/l | Temperature ° C. | Current Density A/dm$^2$ | Pickling Time sec | Descaling | Corrosion Resistance | Cr-decreasing Layer | Shot Blasted Marks |
|---|---|---|---|---|---|---|---|---|---|---|---|---|---|---|---|---|
| 8 | 11Cr | Sample of the Invention | 700 | 5 | 95 | −30 | Not used | 100 | 10 | 45 | 0 | 40 | ○ | ○ | Not Exist | Not Exist |
| 9 | 11Cr | Sample of the Invention | 700 | 5 | 95 | −30 | Not used | 100 | 10 | 45 | 10 | 30 | ○ | ○ | Not Exist | Not Exist |
| 10 | 11Cr | Sample of the Invention | 700 | 5 | 95 | −30 | Not used | 100 | 10 | 45 | 10 | 20 | ○ | ○ | Not Exist | Not Exist |
| 11 | 11Cr | Sample of the Invention | 700 | 5 | 95 | −30 | Used | 100 | 10 | 45 | 10 | 15 | ○ | ○ | Not Exist | Not Exist |
| 12 | 11Cr | Sample of the Invention | 600 | 5 | 95 | −30 | Not used | 100 | 10 | 45 | 10 | 20 | ○ | ○ | Not Exist | Not Exist |
| 13 | 11Cr | Sample of the Invention | 540 | 5 | 95 | −25 | Not used | 100 | 10 | 45 | 10 | 15 | ○ | ○ | Not Exist | Not Exist |
| 14 | 11Cr | Sample of the Invention | 780→ Cooling in Water | 5 | 95 | −30 | Not used | 100 | 10 | 45 | 10 | 15 | ○ | ○ | Not Exist | Not Exist |
| 15 | 11Cr | Sample of the Invention | 700 | 20 | 80 | −40 | Not used | 100 | 10 | 45 | 10 | 30 | ○ | ○ | Not Exist | Not Exist |
| 16 | 11Cr | Sample of the Invention | 700 | 30 | 70 | −30 | Not used | 100 | 10 | 45 | 10 | 40 | ○ | ○ | Not Exist | Not Exist |
| 17 | 11Cr | Sample of the Invention | 600 | 1 | 99 | −30 | Not used | 100 | 10 | 45 | 10 | 40 | ○ | ○ | Not Exist | Not Exist |
| 18 | 11Cr | Sample of the Invention | 600 | 5 | 95 | −30 | Not used | 30 | 5 | 45 | 20 | 20 | ○ | ○ | Not Exist | Not Exist |
| 19 | 11Cr | Sample of the Invention | 600 | 5 | 95 | −30 | Not used | 100 | 10 | 35 | 10 | 20 | ○ | ○ | Not Exist | Not Exist |
| 20 | 11Cr | Sample of the Invention | 600 | 5 | 95 | −30 | Used | 100 | 10 | 35 | 10 | 15 | ○ | ○ | Not Exist | Not Exist |
| 21 | 11Cr | Sample of the Invention | 600 | 5 | 95 | −30 | Not used | 250 | 50 | 40 | 10 | 15 | ○ | ○ | Not Exist | Not Exist |

TABLE 2

| Test No. | Steel Type | | Coiling Temperature (° C.) | Annealing Atmosphere $H_2$ vol % | $N_2$ vol % | Dew Point ° C. | Grinding Brush | Acid-pickling Condition Nitric Acid g/l | Hydrochloric Acid g/l | Temperature ° C. | Current Density A/dm$^2$ | Pickling Time sec | Descaling | Corrosion Resistance | Cr-decreasing Layer | Shot Blasted Marks |
|---|---|---|---|---|---|---|---|---|---|---|---|---|---|---|---|---|
| 22 | 16Cr | Comparative Example | 600 | 5%$O_2$ + 95%$N_2$ | | | Not used | Shot-blasting + sulfuric acid + nitric acid/hydrofluoric acid | | | | 80 | ○ | Δ | Not Exist | Exist |
| 23 | 16Cr | Sample of the Invention | 600 | 3 | 97 | −20 | Not used | 50 | 25 | 40 | 0 | 45 | ○ | ○ | Not Exist | Not Exist |
| 24 | 16Cr | Sample of the Invention | 600 | 3 | 97 | −20 | Not used | 50 | 25 | 40 | 10 | 25 | ○ | ○ | Not Exist | Not Exist |
| 25 | 16Cr | Sample of the | 600 | 3 | 97 | −20 | Used | 50 | 25 | 40 | 10 | 15 | ○ | ○ | Not Exist | Not Exist |

TABLE 2-continued

| Test No. | Steel Type | | Annealing: Coiling Temperature (° C.) | Annealing: Atmosphere $H_2$ vol % | Annealing: Atmosphere $N_2$ vol % | Annealing: Atmosphere Dew Point ° C. | Grinding Brush | Acid-pickling Condition: Nitric Acid g/l | Acid-pickling Condition: Hydrochloric Acid g/l | Acid-pickling Condition: Temperature ° C. | Acid-pickling Condition: Current Density A/dm$^2$ | Acid-pickling Condition: Pickling Time sec | Descaling | Corrosion Resistance | Cr-decreasing Layer | Shot Blasted Marks |
|---|---|---|---|---|---|---|---|---|---|---|---|---|---|---|---|---|
| 26 | 16Cr | Invention Sample of the Invention | 600 | 3 | 97 | −20 | Not used | 50 | 5 | 50 | 10 | 40 | ○ | ○ | Not Exist | Not Exist |
| 27 | 16Cr | Comparative Example | 600 | 3 | 97 | −20 | Not used | 50 | 15 | 50 | 10 | 40 | ○ | ○ | Not Exist | Not Exist |
| 28 | 25Cr | Comparative Example | 350 | 5%$O_2$ + 95%$N_2$ | | | Not used | Shot-blasting + sulfuric acid + nitric acid/hydrofluoric acid | | | | 80 | ○ | ○ | Not Exist | Exist |
| 29 | 25Cr | Comparative Example | 350 | 5%$O_2$ + 95%$N_2$ | | | Not used | Sulfuric acid + nitric acid/hydrofluoric acid | | | | 80 | X | Δ | Not Exist | Not Exist |
| 30 | 25Cr | Sample of the Invention | 350 | 5 | 95 | −30 | Not used | 150 | 10 | 45 | 30 | 30 | ○ | ○ | Not Exist | Not Exist |
| 31 | 30Cr | Comparative Sample | 350 | 5 | 95 | −30 | Not used | 150 | 10 | 45 | 30 | 40 | X | ○ | Not Exist | Not Exist |
| 32 | 30Cr | Comparative Sample | 350 | 5 | 95 | −30 | Not used | 250 | 40 | 50 | 30 | 50 | X | Δ | Not Exist | Not Exist |

INDUSTRIAL APPLICABILITY

As has been mentioned hereinabove, the present invention is expected to produce the following effects:

1 The hot-rolled, Cr-containing steel strips of the invention have, after having been acid-pickled, no shot blasted marks on their surface. The steel strips have good surface lies, and can be polished well. They have no Cr-decreasing layer on their surface, and have good corrosion resistance.

2 The hot-rolled, Cr-containing steel strips of the invention are substitutable. for cold-rolled steel strips in the field where only cold-rolled steel strips have heretofore been usable.

3 In the method of the invention, the acid-pickling treatment after the steps of hot-rolling and annealing is greatly simplified, by which the producibility in the method is significantly improved. According to the method-of the invention, therefore, the hot-rolled, .Cr-containing steel. strips can be produced at low costs.

What is claimed is:

1. A method for producing a hot-rolled, Cr-containing steel strip, which comprises: hot-rolling a steel slab having a Cr content of from 6.0 to 25.0% by weight; coiling the thus-obtained steel strip at a temperature not higher than 700° C.; thereafter annealing the strip in a reducing atmosphere, wherein the annealing atmosphere is comprised of hydrogen gas and nonoxidizing gas while having a hydrogen concentration of not smaller than 1% by volume, and has a dew point falling between −60° C. and 0° C.; and thereafter acid-pickling the strip in a solution of nitric acid/hydrochloric acid.

2. The method for producing a hot-rolled, Cr-containing steel strip as claimed in claim 1, and quenching the strip in water immediately after coiling.

3. The method for producing a hot-rolled, Cr-containing steel strip as claimed in claim 1, wherein the steel slab has a Cr content of from 9.0 to 25.0% by weight.

4. The method for producing a hot-rolled, Cr-containing steel strip as claimed in claim 1, wherein the strip is, after having been annealed and before being acid-pickled, brushed with a brushing roll having a grinding ability.

5. The method for producing a hot-rolled, Cr-containing steel strip as claimed in claim 1, wherein the solution of nitric acid/hydrochloric acid for the acid-pickling has a nitric acid concentration of from 10 to 300 g/liter and a hydrochloric acid concentration of from 1 to 50 g/liter, and its temperature falls between 35 and 65° C.

6. The method for producing a hot-rolled, Cr-containing steel strip as claimed in claim 1, wherein the acid-pickling is effected by electrolytically dipping the strip in a solution of nitric acid/hydrochloric acid at a current density of from 1 to 30 A/dm$^2$.

7. The method for producing a hot-rolled, Cr-containing steel strip as claimed in claim 4, wherein the brushing roll for the brushing treatment is composed of grinding grains of at least one or more selected from alumina, silicon carbide and tungsten carbide, and a roll that is elastic and deformable in accordance with pressure applied thereto.

8. The method for producing a hot-rolled, Cr-containing steel strip as claimed in claim 5, wherein the solution of nitric acid/hydrochloric acid for the acid-pickling has a nitric acid concentration of from 50 to 200 g/liter and a hydrochloric acid concentration of from 3 to 30 g/liter.

9. The method for producing a hot-rolled, Cr-containing steel strip as claimed in claim 5, wherein the temperature of the solution of nitric acid/hydrochloric acid for the acid-treatment falls between 40 and 60° C.

10. The method for producing a hot-rolled, Cr-containing steel strip as claimed in claim 6, wherein the current density is from 5 to 25 A/dm$^2$.

11. The method for producing a hot-rolled, Cr-containing steel strip as claimed in claim 1, wherein the coiling temperature at which the hot-rolled strip is coiled is not higher than 600° C.

12. The method for producing a hot-rolled, Cr-containing steel strip as claimed in claim 1, wherein the hydrogen concentration is from 1 to 20% by volume.

* * * * *